United States Patent [19]

Hiser

[11] 4,193,352

[45] Mar. 18, 1980

[54] FOLDING TABLE

[76] Inventor: Noble M. Hiser, 3019 E. Drachman St., Tucson, Ariz. 85716

[21] Appl. No.: 934,520

[22] Filed: Aug. 17, 1978

[51] Int. Cl.[2] ..... A47B 3/08

[52] U.S. Cl. ..... 108/126; 108/130

[58] Field of Search ..... 108/126, 123, 130; 248/169

[56] References Cited

U.S. PATENT DOCUMENTS

| | | | |
|---|---|---|---|
| 2,022,345 | 11/1935 | Hansen | 108/126 |
| 2,042,326 | 5/1936 | Weed | 108/130 |
| 2,074,123 | 3/1937 | Jackson | 108/126 |
| 2,107,252 | 2/1938 | Willett | 108/126 |
| 2,518,783 | 8/1950 | Hiser | 108/126 |
| 2,618,523 | 11/1952 | Boyce | 108/130 |

*Primary Examiner*—Francis K. Zugel

*Attorney, Agent, or Firm*—Victor J. Evans & Co.

[57] ABSTRACT

A table with foldable legs which includes a table top having a flange extending around the edge with pivotally mounted legs at the corners moveable between a folded and an extended position, with guide elements mounted on the flange adjacent each leg for slidably supporting slide members connected by means of braces to the legs all of the slide members being interconnected for simultaneous movement during the pivotal movement of the legs by links connected to the outer ends of cross-arms mounted for pivotal movement on the center of the table, one of the links being provided with a locking lug for locking engagement with a locking plate on the flange with a spring biased linkage for yielding by urging the one link pivotally towards the flange for locking engagement connected to the one link with the locking plate in the extended position of the legs and the spring biased linkage for moving the one link in the opposite direction for releasing the locking lug to permit the legs to be pivoted into the folded position.

4 Claims, 4 Drawing Figures

FIG 1
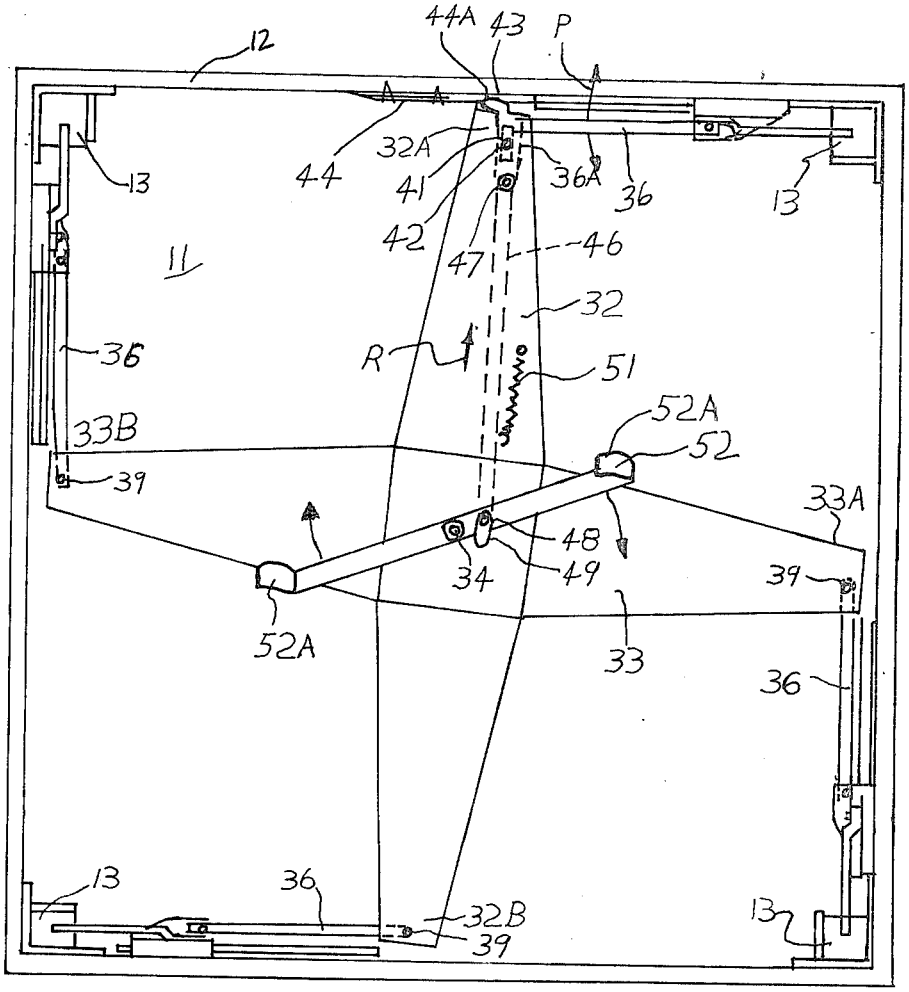
FIG 2
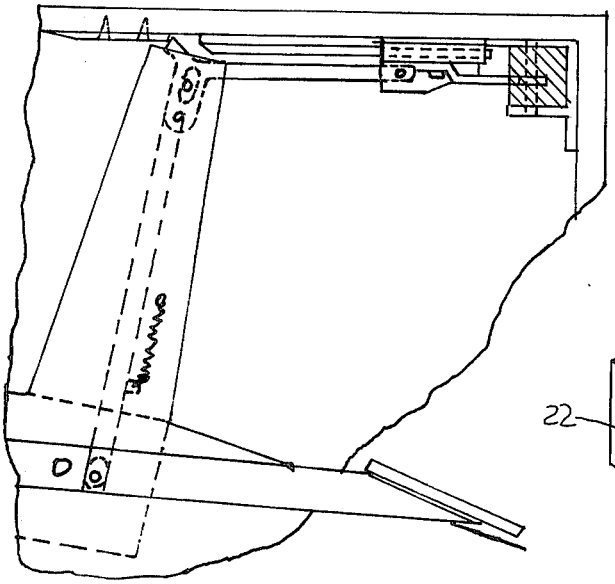
FIG 3
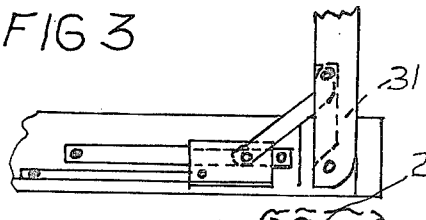
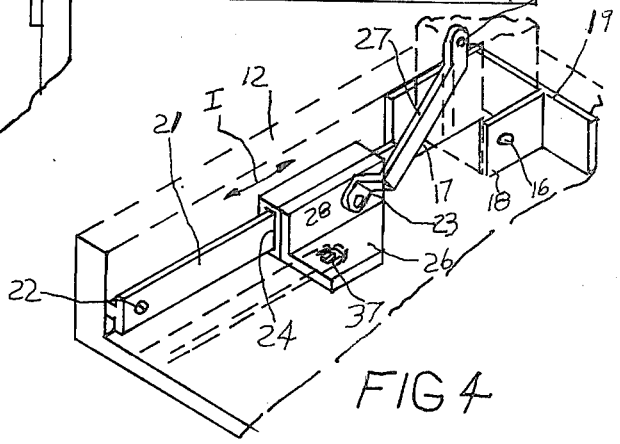
FIG 4

FOLDING TABLE

BACKGROUND OF THE INVENTION

Tables with folding legs are in common use today and one widely used type of such table is referred to as a "card table". Such card tables are used generally for the playing of card games such as bridge and are adapted to be quickly and easily set up for playing and folded for storage. One such card table is described and claimed in U.S. Pat. No. 2,518,783 entitled Folding Table Legs with Actuation Mechanism and issued Aug. 15, 1950 to N. M. Hiser and applicant of the present invention. The present invention constitutes an improvement of the table of the aforementioned patent.

OBJECTS AND SUMMARY OF THE INVENTION

A primary object of this invention is to provide a new and novel table with folding legs which is simple and lightweight in construction and in which the legs may be simply and easily moved into an extended position for use or into a folded position for storage.

Another object of this invention is to provide a new and novel table with folding legs in which the legs are automatically and positively locked in the extended position for use but which permits the legs to be easily released from the locked position for folding up together into a folded position for storage or the like.

In general the objects of the invention and other related objects are accomplished by the provision of a table top having a edge flange at the corners of which are mounted legs pivotally moveable between a folded position and an extended position each leg being connected by a pivotally mounted brace to a slide member slidably mounted on a guide element secured to the flange adjacent each leg. A pair of cross-arms are mounted for rotary movement on a center each of the outer ends of the cross-arms connected by means of a link to a slide member for pivotal movement of the legs together between the folded and extended positions, one of the links provided with a lug and connected to a release lever by means of an arm, the one link being urged by a spring towards the flange for locking engagement between the lug and a keeper on the flange in the extended position of the legs.

Other objects and advantages will become apparent in the following specification when considered in light of the attached drawings.

BRIEF DESCRIPTION OF THE DRAWINGS

FIG. 1 is a bottom plan view of a folding table constructed in accordance with the invention showing the legs in the extended position;

FIG. 2 is an enlarged fragmentary view of a portion of the table top of FIG. 1;

FIG. 3 is an elevational view of a corner portion of the table top of FIG. 1; and FIG. 4 is a perspective view of the portion of the folding table shown in FIG. 3.

DESCRIPTION OF THE PREFERRED EMBODIMENT

Referring now to the drawings and to FIG. 1 in particular, there is shown a folding table constructed in accordance with the invention and designated generally by the letter T. The folding table T is of the type commonly referred to as a folding "card" type table and includes a flat top 11 preferably of substantially square shape. The top 11 is provided with a downwardly depending side flange 12 extending around all of the side edges of the top. A leg 13 is provided at each of the corners of the table T and is arranged in the conventional manner for pivotal movement between an extended position as shown in FIG. 1 and a folded position in underlying relationship with the bottom of the table top 11. More specifically, as shown best in FIG. 4 each of the legs 13, like numerals being used to identify like parts, is pivotally mounted on a pivot pin 16 extending between spaced flanges 17, 18 with the inner end of the leg disposed therebetween. The flanges 17, 18 forming part of a mounting bracket 19 suitably secured in nested relationship between the adjacent sections of flange 12 at each corner of the table top 11.

Adjacent each of the legs 13, a guide element 21 is suitably secured by means such as screws 22 to the inner wall of the flange 12. The guide element 21 being preferably of T-shaped cross sectional area and extending longitudinally along the flange 12. Each of the guide elements 21 is arranged to slidably support a slide member 23 for sliding movement in the direction of the double arrow I on the guide element 21. The slide member 23 includes a slot 24 for slidably accommodating the guide element 21 and a laterally extending flange 26 on the opposite side from the slot 24.

Each of the slide members 23 is connected to the associated leg 13 by means of a bracing member 27 pivotally connected at one end to the slide member 23 by means of a pivot pin 28 and at the other end to the leg 13 by means of pivot pin 29. Preferably, each leg is provided with a centrally located slot 31 for accommodating the end portion of the bracing member 27 which is preferably angularly disposed with respect to the remaining portion of the bracing member.

Means are provided for interconnecting all of the slide members 23 for simultaneous movement of the slide members 23 with an accompanying simultaneous movement of the legs 13 between the extended position of FIG. 1 and a folded position. More specifically, the interconnecting means includes a pair of cross-arms 32, 33 as shown best in FIG. 1 arranged in an intersecting relationship and arranged for pivotal movement at their center around a pivot pin 34. The outer end 33A, 33B of cross-arm 33 and the outer ends 32A, 32B of cross-arm is connected by means of a link 36 to an associated one of the slide members 23. The outer end of each of the links 36 being pivotally connected by means of a pin 37 to the flange 26 of the slide members 23 as shown best in FIG. 4. The inner ends of the links 36 are connected to the outer ends 33A, 33B and 32B by means of pins 39 and the inner end of the link 36 connected to the outer end 32A of the cross-arm 32 forms a locking member for the legs 13 and includes an extension 36A provided with a slot 41. A pin 42 positioned in the cross-arm outer end 32A extends through the slot 41 so that the link 36 is both pivotally connected to the outer end 32A of the cross-arm 32 as well as being permitted to move towards and away from the flange 12 in the direction of the double arrow P. The inner end of the link 36 opposite the extension 36A is formed with a locking lug 43 which is arranged to lockingly engage with a shoulder 44A at one end of a keeper means such as a plate member 44 suitably mounted by screws or the like on the inner surface of the flange 12 as shown best in FIG. 1.

Means are provided for yieldingly urging the locking member 43 into locking engagement with the keeper means or plate member 44 in the extended position of the legs 13. More specifically, an arm 46 is pivotally connected at one end by means of pivot pins 47 to the extension 36A and at its opposite end to the cross-arms 32, 33 by means of a pin 48 extending within a slot 49 provided in the cross-arms 32, 33. In the preferred embodiment the urging means includes a spring 51 connected at one end to the arm 46 and at the other end to the cross-arm 32 so that the arm 46 is yieldingly urged in the direction of arrow R.

Manually operated means are provided for pivotally moving the locking member or link 43 out of locking engagement between the lug 43 and shoulder 44A against the force of the urging means or coil spring 51 to permit the legs 13 to be pivotally moved simultaneously into the folded positions. More specifically, a lever 52 having end portions 52A, 52B is pivotally mounted on the cross-arms 32, 33 by means of pivot pins 34 the lever 52 being connected to the pin 48 on the arm 46.

In the position of the parts shown in the drawings, the legs 13 are in the operative extended position with the locking lug 43 in locking engagement with the plate member shoulder 44A and held therein by means of the spring 51. To place the table T in the folded condition, the lever 52 is rotated in the direction of the arrows so that the arm 46 is moved in the opposite direction of the arrow R against the urging force of the spring 51 to pivot the locking member or link 43 inwardly around its slide member 23 thereby withdrawing the locking lug 43 from locking engagement with the shoulder 44A. The legs 13 are then folded inwardly with simultaneous folding of all the legs due to the interconnection between the links 36 and the cross-arms 32, 33 the locking lug 43 sliding on the surface of the plate member 44 so that the legs 13 ultimately are placed in the folded position in underlying relationship with the table top 11. In the movement of the legs 13 to the extended position movement of the legs 13 are accomplished by movement of a single leg in the reversed manner so that the locking lug 43 sliding along the plate members surface ultimately passes the shoulder 44A so that the link 43 is pivoted outwardly under the urging force of the spring 51 with the locking lug 43 moving inwardly as permitted by the slot 41 and into the locking position of FIG. 1.

Having thus described the preferred embodiment of the invention it should be understood that numerous structural modifications and adaptations may be resorted without departing from the spirit of the invention.

What is claimed is:

1. A folding table comprising, in combination, a top, a downwardly depending flange extending along the marginal edge of said top, a plurality of legs pivotally mounted on said flange each disposed adjacent a corner of said top for pivotal movement between a folded position and an extended position, a guide element mounted on said flange adjacent each of said legs, a slide member slidably mounted on each of said guide elements, brace means pivotally connecting each of said slide members to the associated leg for sliding movement of said slide member on said guide element during the pivotal movement of said legs between said folded position and said extended position, a pair of cross arms disposed in intersecting arrangement at a central portion of the table through a pivot pin and extending outwardly toward the flanges of said table, plural links one each pinned to an extremity of said cross arms and to each of said slide elements for three of the legs, a single locking member connecting one cross arm extremity to a flange including a pin disposed on said extremity slideably constrained in a slot formed in an extension of said remaining link wherein said pin is connected to the remaining link so that said remaining link can move along the line of said cross arm and said remaining link has formed at the end near the slot a locking lug (43) adapted to latch against a keeper (*44a*) fastened to the flange of the table, an arm (46) underlying said one cross arm extremity (32) pinned to said extension (*36a*) and pinned through slots (49) disposed in the cross arms (32,33) at their juncture, a spring (51) extending between the cross arm and the arm (46) to bias said lug (43) into said keeper (*44a*) and means (52) for retracting said locking lug (43) from said keeper (*44a*).

2. The device of claim 1 wherein said means for retracting comprises a lever (52) pivoted to said cross arms at their area of interconnection and the arm (46) pivot (49) is connected thereto whereby rotation of said lever retracts said arm and therefore said lug (43) from said keeper.

3. The device of claim 2 in which end portions are disposed on said lever (52) at the extremities thereof.

4. The device of claim 1 wherein said guide elements (21) are of "T" shaped cross section, said slide element rides over the top of the "T" and said links (36) are connected to said slides at a laterally extending flange (26) thereof.

* * * * *